United States Patent [19]

Gilfillan

[11] Patent Number: 4,913,629

[45] Date of Patent: Apr. 3, 1990

[54] WELLPOINT PUMPING SYSTEM

[76] Inventor: William C. Gilfillan, 255 Lakeside Blvd., Hopatcong, N.J. 07843

[21] Appl. No.: 236,946

[22] Filed: Aug. 26, 1988

[51] Int. Cl.[4] ..... F04B 49/00

[52] U.S. Cl. ..... 417/309; 417/440

[58] Field of Search ..... 417/299, 307, 309, 364, 417/380, 200, 435, 440; 415/56.1, 56.5

[56] References Cited

U.S. PATENT DOCUMENTS

| | | | |
|---|---|---|---|
| 1,053,677 | 3/1912 | Sutton | 418/178 |
| 1,074,098 | 9/1913 | Astrom | 417/435 |
| 1,757,299 | 5/1930 | Ferguson | 415/56.5 |
| 2,033,744 | 3/1936 | Skidmore | 417/200 |
| 2,071,703 | 2/1937 | Nelson et al. | 417/200 |
| 2,492,935 | 11/1943 | McCulloch et al. | 418/144 |
| 2,567,699 | 4/1947 | Devlin | 418/153 |
| 2,697,402 | 9/1950 | Lindquist | 418/153 |
| 2,833,224 | 3/1956 | Meyer et al. | 418/83 |
| 3,015,283 | 11/1959 | Knipp | 418/114 |
| 3,039,398 | 11/1959 | de Michelis | 418/153 |
| 3,198,120 | 10/1962 | Little, Jr. | 417/252 |
| 3,381,619 | 7/1966 | Mingot | 418/126 |
| 4,515,180 | 5/1985 | Napolitano | 417/200 X |
| 4,606,704 | 8/1986 | Sloan | 417/364 X |

*Primary Examiner*—Leonard E. Smith
*Assistant Examiner*—Eugene L. Szczecina, Jr.
*Attorney, Agent, or Firm*—Webb, Burden, Ziesenheim & Webb

[57] ABSTRACT

A wellpoint pumping system having a frame and a positive displacement rotary pump for pumping air, water or a mixture thereof mounted on the frame. The pump has two rotors with intermeshing lobes mounted on horizontal and parallel shafts, an inlet port below the rotors and an outlet port above the rotors. A motor for driving the rotors is mounted on the frame and a coupler connects the motor to the rotors. A closed inlet reservoir is formed in the frame below the pump, and an outlet reservoir is mounted on the frame at a level above the inlet reservoir. A conduit depends from the pump inlet port into the inlet reservoir and terminates close to the bottom of the inlet reservoir and a conduit connects the outlet port of the pump with the outlet reservoir. An opening is located between the lowermost portion of the outlet reservoir and the inlet reservoir and an adjustable recirculation control valve is located in the opening to control the rate of flow through the opening from the outlet reservoir to the inlet reservoir.

10 Claims, 2 Drawing Sheets

WELLPOINT PUMPING SYSTEM

BACKGROUND OF THE INVENTION

1. Field of the Invention

The invention relates generally to a we pumping system for extracting ground water and more particularly to a pump for extracting ground water from construction excavations so construction operations can be performed in a dry subgrade. Prior to excavation the site to be excavated is surrounded by a plurality of wellpoints (small diameter wells) driven, drilled or jetted into the aquifer underlaying the site. The individual wellpoints are connected to a common collector pipe called a header pipe. Rigid pipes rise to the ground surface (risers) and flexible hoses (swings) connect the risers to the header. A wellpoint pump is connected to the header pipe and in operation creates a vacuum on the header which causes the ground water to enter the wellpoints, flow up the riser, pass through the swings into the header and through the pump to a discharge point off site.

While the nature of aquifers vary greatly, the demands on a wellpoint pump are generally the same. At the beginning of the pumping operation, the water level is at its highest and therefore, the water flow rate to the pump is highest. As pumping continues, the ground water level drops, increasing the suction lift requirement of the pump. As the ground water level approaches its lowest point, air enters the wellpoints and the water flow rate is substantially reduced. A wellpoint pump is required to operate continuously (24 hours a day) under these conditions, and is often operating close to cavitation, i.e., high vacuum in the suction; pumping large volumes of air and low volumes of water to maintain the lower ground water level for long time periods until the excavation and the operations below subgrade are completed. The discharge head requirement on wellpoint pumps is generally low in the range of 10 to 20 feet of water.

The system of the invention uses a single positive displacement rotary pump which replaces a conventional centrifugal pump (water pump) and a vacuum pump (air pump) and eliminates the need for an air-water separator. The pumping system of the invention operates at approximately $\frac{1}{3}$ engine speed as compared to full engine speed on systems including a centrifugal pump. Additionally, there are less than one-third the number of parts in the pump system of the invention than in prior art systems. Such results in greater reliability and less maintenance. Also, the pump system of the invention is very efficient due to balanced water/air flow.

While applicant's pumping system was originally designed and configured as a wellpoint pump, this unique pumping system has numerous other applications.

2. Description of the Prior Art

There are various types of known wellpoint pump systems. The pump system most commonly used consists of a prime mover (usually a diesel engine) directly driving a centrifugal pump and a belt driving a vacuum pump. An air-water separator with a plurality of floats and valves located in the pump suction line directs air to the vacuum pump and water to the centrifugal pump. These major components along with their respective cooling and or lubricating devices, reservoirs, drive components and connecting flow lines and valves are usually mounted on a structural steel frame for portability. As is evident, this type of wellpoint pump is mechanically and hydraulically complicated. When considering the major components along with the accessory requirements, these prior art pumping systems contain a large number of parts and require a substantial amount of maintenance when operating continuously at or near cavitation.

In another type of known wellpoint pump system, a single positive displacement pump is used to pump both air and water. This system is disclosed in the sales literature of Thompson Pump and Manufacturing Company of Port Orange, Fla. The pump is mounted for horizontal inlet and horizontal outlet. Thus, it tends to run inefficiently because the flow through the pump is unbalanced. Air flows through the upper portions of the rotor vanes and liquid flows through the lower portions. Moreover, the pump has no provision for recirculation and therefore cannot operate for long periods pumping only air. A pump of this type is shown in U.S. Pat. No. 2,697,402.

SUMMARY OF THE INVENTION

The invention is a wellpoint pumping system comprising a frame which supports a positive displacement rotary pump capable of pumping air, water or a mixture thereof and a drive motor for driving the pump. A coupling couples the drive motor to the pump. The pump has two rotors with intermeshing lobes mounted for counter rotation upon substantially horizontal and parallel shafts. The pump has a downwardly opening inlet port below the rotor lobes and an upwardly opening outlet port above the rotor lobes. An air-tight inlet reservoir is formed in the frame below the pump. An outlet or discharge reservoir is mounted on the frame at a level above the inlet reservoir. Conduit means pendent from the pump inlet port extend into and terminate close to the bottom of the inlet reservoir. Conduit means connect the outlet port of the pump with the outlet reservoir. The lowermost portion of the outlet reservoir may be connected to the air-tight inlet reservoir by an adjustable recirculation control valve which controls the rate of flow from the outlet reservoir into the inlet reservoir.

In wellpoint operations, it is preferred to automate the operation of the control valve with a vacuum actuated cylinder and a spring mechanism attached to the handle in a "push-pull" arrangement so that at low vacuum during startup the spring holds the valve open for full water recirculation as the air is pumped from the system. As the vacuum on the system approaches 15" of mercury, the cylinder begins to overpower the spring and close the valve. At 23" of mercury, the cylinder is fully retracted; the spring is fully extended; and the valve remains approximately $\frac{1}{3}$ to $\frac{1}{4}$ open, thereby recirculating a minimum amount of water. The importance of this arrangement is that during unattended operations, should a major air leak occur in the wellpoint system and the system vacuum decrease below 15" of mercury, the spring will fully open the recirculation valve, preventing the pump from running dry because at this lower vacuum no water would be flowing into the system.

Preferably, in a wellpoint pumping system according to the invention, there is a check valve at the highest point on the outlet reservoir which allows air to be discharged while maintaining the recirculation water to the pump. It is also preferred that the inlet reservoir is divided to provide a suction box section in which a filter screen may be placed to remove solids from the intake fluid. It is further preferred that the frame defines multiple air-tight compartments one of which is the inlet reservoir and other of which is a fuel tank for the diesel engine. According to the most preferred embodiment, the pump rotor vanes are fabricated from a metal frame having an elastomer molded thereabout to define the shape of the vanes.

BRIEF DESCRIPTION OF THE DRAWINGS

Further features and other objects and advantages of the invention will become clear from the following description of the preferred embodiment made with reference to the drawings in which.

DESCRIPTION OF THE PREFERRED EMBODIMENT

Figure 1:
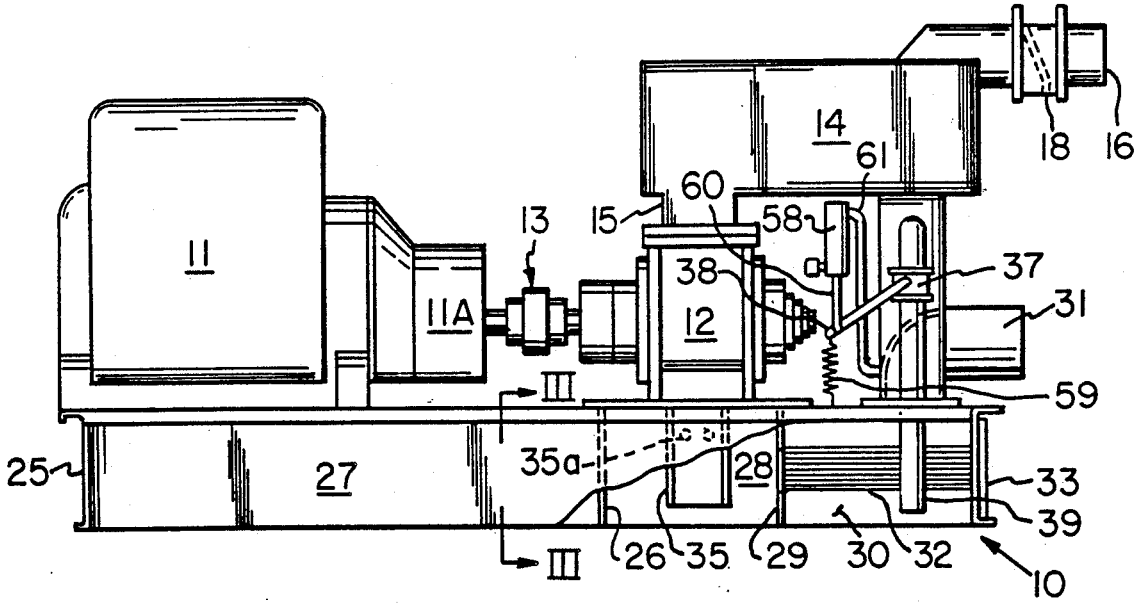
FIG. 1 is a side view of a pumping system according to this invention with portions broken away.
Figure 2:
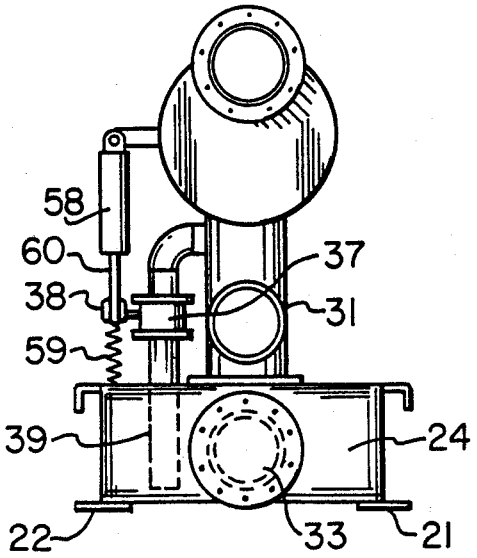
FIG. 2 is an end view of the pumping system shown in FIG. 1.

Referring to FIGS. 1 and 2 of the drawings, the pumping system includes a frame 10 supporting a prime mover or drive motor 11, a positive displacement pump 12 and a coupling 13 between the prime mover and the pump. A gear reducer IIA is located between the prime mover 11 and coupling 13. An outlet reservoir 14 is also mounted on the frame and a pump outlet conduit 15 connects the outlet of the pump 12 with the outlet reservoir. The outlet reservoir exhaust conduit 16 opens from the outlet reservoir above the location where the pump outlet conduit 15 opens into the outlet reservoir. The outlet conduit 16 extends into the outlet reservoir and is provided with a spring loaded check valve 18 so that if the pump shuts down, the valve automatically closes.

Figure 3:
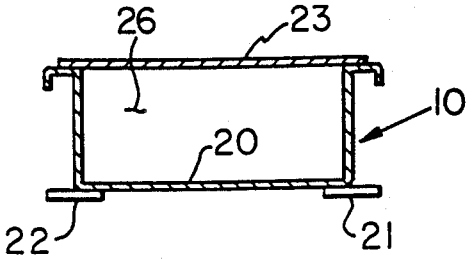
FIG. 3 is a vertical section of the frame on line III—III in FIG. 1.

Referring to FIG. 3 of the drawings, the frame 10 is a large horizontally extending U-shaped channel 20 with skids 21 and 22 welded to the bottom corners. The top of the channel has a cover 23 welded in place forming a rectangular enclosure. The ends of the channel are closed by end plates 24 and 25 which are welded in place. An imperforate baffle wall 26 (See FIG. 1) is located approximately midway along the length of the channel. Thus, the frame 10 defines two separate liquid-tight compartments. The compartment 27 beneath prime mover 11 is a fuel tank and the compartment beneath the pump is the inlet reservoir.

The inlet reservoir has a baffle wall 29 which divides off a portion of the reservoir to form a suction box 30. The reservoir intake conduit 31 opens downwardly through the cover plate 23 into the suction box 30 of the inlet reservoir. A cylindrical screen 32 is positioned in the suction box with one end being closed off by an end cover 33 and the other end opening upon an opening in baffle wall 29. The cylindrical screen can be removed through a cover plate 33 on end plate 24 for cleaning or replacements. Intake fluid passes through cover plate 23 to the exterior of cylindrical screen 32 and then through the cylindrical screen and through the opening in baffle wall 29. A pump pickup tube 35 extends downwardly from the pump 12 and has an inlet end in close proximity to the bottom of inlet reservoir 28.

The outlet reservoir 14 and suction box 30 are in communication through an adjustable valve 37 that is positioned on a valve actuation stem 38 controlled by a vacuum actuated cylinder 58 and spring 59. A depending conduit 39 in the inlet reservoir receives the recirculation flow from valve 37 and directs it to the exterior of cylindrical screen 32 in close proximity to the bottom of suction box 30.

Figure 4:
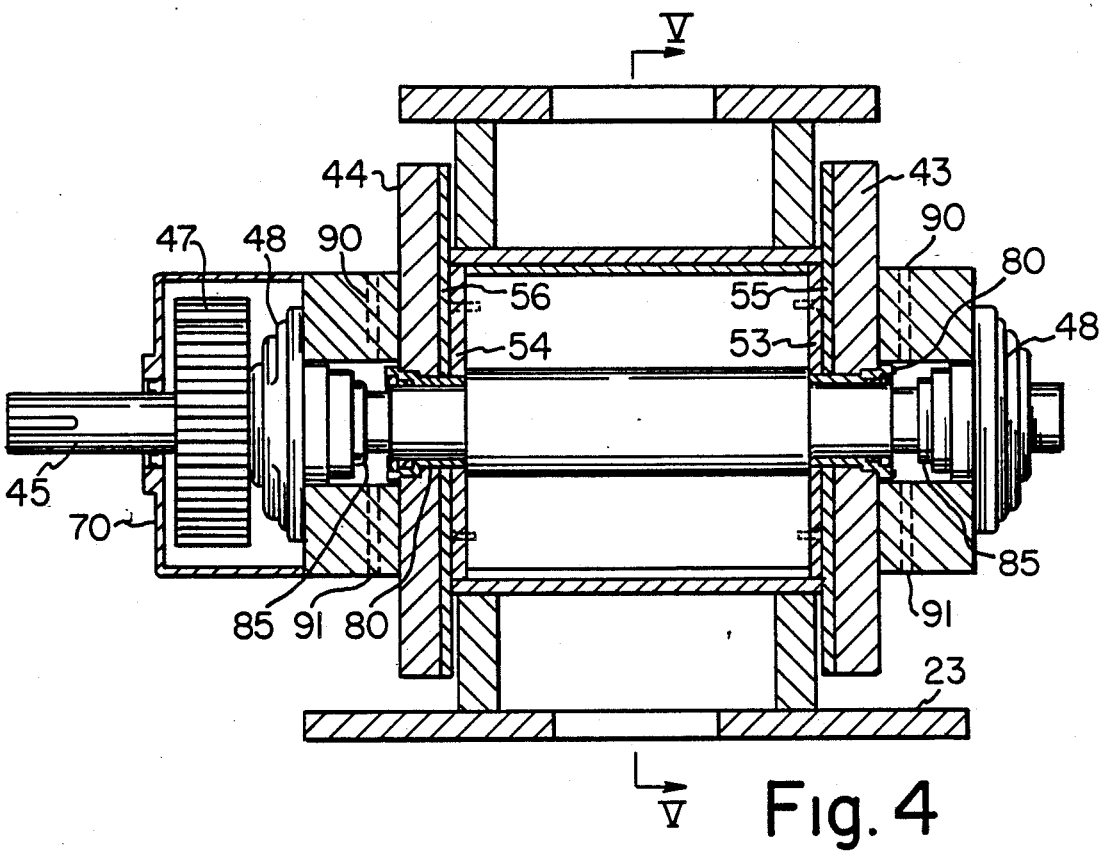
FIG. 4 is a vertical section through the pump used in the pumping system of FIG. 1.
Figure 5:
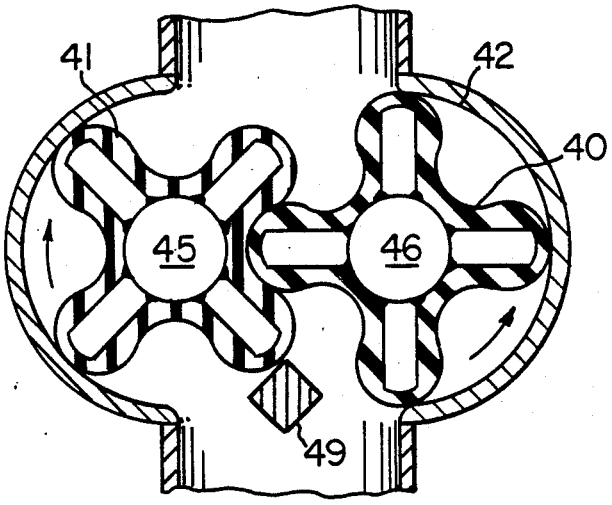
FIG. 5 is a vertical section through the pump on lines V—V of FIG. 4.
Figure 6:
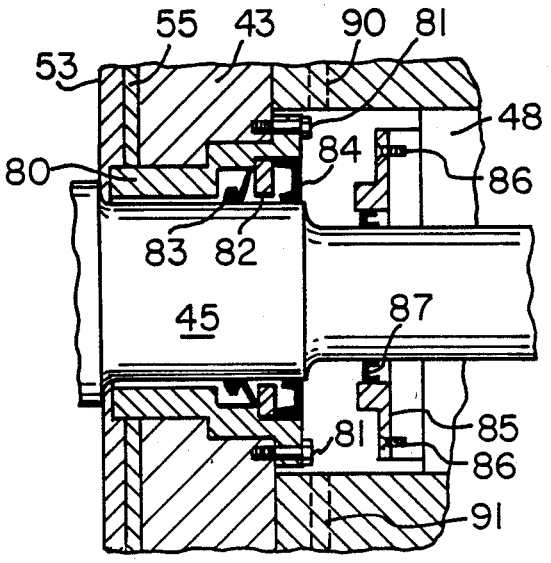
FIG. 6 is a broken partial section through one of the shaft seals in the pump shown in FIGS. 4 and 5.

The details of the pump 12 will be understood by reference to FIGS. 4, 5 and 6 of the drawings. The pump consists of two identical rotors 40 and 41 having a plurality of intersecting lobes. The lobes maintain an interlocking contact at the points of intersection. The rotors rotate in opposite directions inside of housing 42 which has removable end plates 43 and 44. Each end plate is equipped with a removable stainless steel wear plate designated 55 and 56 which is spaced from the housing by paper shims to provide rotor end clearance of 0.002"±. Each rotor shaft 45 and 46 is equipped with a concentric spur gear 47 (only one being shown in FIG. 4) to transmit rotary motion to the shaft. The driven rotor shaft 45 is extended and driven by the prime mover 11.

The lobes of rotors 40 and 41 are coated with a resilient material such as urethane rubber so that they can operate with zero clearance at the point of contact and provide a positive seal. As shown by the arrows in FIG. 5 of the drawings, the right hand rotor 40 is driven counterclockwise and the left hand rotor 41 rotates clockwise.

When the rotors are in operation, the volume in the bottom of the pump bounded by the rotors 40 and 41, the lower part of housing 42 and the lower part of end plates 43 and 44 is an expanding volume, and thus draws fluid through the inlet into the pump. Conversely, the volume in the top of the pump is a contracting volume expelling fluid from the outlet. The fluid being pumped is trapped between the rotors, the housing and the end plates and is positively displaced from suction to discharge as the rotors rotate. The zero clearance in the area of intersection in the center prevents the fluid from recirculating from the pressure side to the vacuum side in this zone. A guide vane 49 is positioned in the center of the suction side to prevent the rotors from impeding the inflow of fluid and to direct the in-flowing fluid tangently of the rotor tip to improve efficiency.

The fluid being pumped fills the relatively small (0.020"±) clearance space between the rotors and the housing and the rotors and the end plates and prevents substantial recirculation in those zones to the extent that when pumping a mixture of air and water it is possible to maintain a vacuum of 28 inches of mercury on the suction side with normal low operating pressures on the discharge side.

Referring to FIG. 6 of the drawings, the rotor shafts are sealed from water and air leakage by a multiple seal arrangement which provides for seal replacement without complete disassembly of the pump: A bronze seal gland 80 fits into a machined counterbore in each pump end plate 43 and 44 and protrudes into a machined counterbore in the rotor shoes 53 and 54. The inner diameter of each seal gland is machined for a 0.020"± running fit with the rotor. The protrusion of 80 into the rotor shoe 53 and the journal clearance between 80 and the shaft 45 in itself minimizes the amount of leakage which occurs at the interface between the rotor and the end plates 43 and 44. A florsheda V ring seal 83 is contained inside the seal gland on the shaft and rotates with the shaft. The V ring seal 83 seals with a thin edge against the machined bronze ring 82 which slip fits into a counterbore in the sale gland 80 and is held in place by an internal step formed in 80 on the one side and by the press fit of a high pressure lip seal 84 on the other side. The V ring seal 83 prevents sand contained in the water being pumped from damaging the high pressure seal 84. Each seal gland 80 has a flange on the outer end and the flange contains three screws 81 which hold the seal gland in place. End plate 43 has three tapped holes which receive screws 81 to attach seal gland 80 to end plate 43.

The space defined by the seal gland 80, bearing 48 and shaft 45 is vented by a drilled hole 90 and drained by a drilled hole 91.

To insure that water leakinq from the seals doesn't contaminate the bearinqs before it can drain, each bearing is fitted with a steel seal plate 85 held in place by three screws 86. A lip seal 87 is pressed into the seal plate with the lip facing the bearing to retain the bearing lubricant and provide a passive restraint for water entry.

Each rotor shaft is supported by conventional grease-lubricated, self-aligning spherical roller bearings 48 mounted in the end plates. The spur gear operates in an oil bath gear case 70.

The pump rotors 40 and 41 consist of steel bars welded to the steel rotor shafts 45 and 46 to form a rotor core. The steel rotor core is then locked in a core box and coated with 80+ durometer urethane rubber to provide the finished shape. Each rotor end is equipped with removable rotor shoes 53 and 54 mechanically attached to the rotor core embedded in epoxy. The purpose of the rotor shoes is to provide wear resistant replaceable elements to prevent erosion of the urethane rubber due to abrasion and cavitation.

The replaceable rotor shoes 53 and 54, end wear plates 55 and 56 and paper shim gaskets allow the pump to be inexpensively maintained at operating tolerance as wear occurs.

By a proper selection of the design parameters and component materials, the pump can be used to pump various liquid and gas mixtures at various suction and discharge conditions and flow rates.

The parameters for the specific embodiment being described were chosen for a typical wellpoint pump application, i.e., up to 1500 GPM of water and 200 CFM of air at a suction pressure of about 28 inches of mercury and a discharge head pressure of 20 feet of water with a 35 HP diesel prime mover.

In operation the liquid and air flow into the pump suction box 30 through intake conduit 31 and then through screen 32 which screens out solids larger than a predetermined size and further mixes the air and liquid which enters the operating sump of the inlet reservoir 28 through an opening in baffle wall 29. The operating sump is in communication with the pump suction inlet through a pickup tube 35 which terminates within one inch of the sump bottom. This feature allows the pump to substantially empty liquid from the sump before it pulls only air. Small holes 35*a* through the tube 35 at the top allow the sump to maintain a full level while pumping at steady state. The liquid and air are pumped by the pump into the discharge reservoir 14. The outlet of the discharge reservoir is equipped with a spring loaded check valve 18 to prevent a backflow of air during start up. Water and air separate in the discharge reservoir with the air rising to escape out the discharge pipe 16. The water level rises in the discharge reservoir 14 at a rate dependant upon the flow rate into the inlet pipe and the position of the recirculation valve 37 until it flows with air out the exhaust pipe 16.

The recirculation valve 37 is controlled by a vacuum actuated cylinder 58 and spring 59 which are connected to opposite sides of one end of valve handle 38.

Cylinder 58 contains a piston which is positioned between the upper cylinder vacuum end and the lower cylinder atmosphere end. The piston is attached to the upper end of a rod 60 which extends from lower end of cylinder 58 and the lower end of rod 60 is attached to one end of valve actuation handle 38. A tube 61 connects the vacuum end of cylinder 58 to suction box 30. The pressure differential across the piston in cylinder 58 causes the piston within the cylinder to move rod 60 in a corresponding direction to move handle 38 and adjust valve 37.

In operation, as the vacuum increases, the piston and the rod of cylinder 58 move handle 38 in a valve closing direction against the force of spring 59 to reduce the amount of water recirculation. As the vacuum decreases, spring 59 moves handle 38 in a valve opening direction to increase the amount of water recirculation.

Operating thusly adjustment of valve 37 provides maximum recirculating water during periods of low vacuum when the water flow is at a minimum and provides minimum recirculating water during periods of maximum vacuum when the water flow is at a maximum. This valve action causes pump 12 to operate at maximum vacuum and prevents it from operating without water flow.

In the case where the water flow equals the pump's capacity, the recirculation valve 37 remains slightly open to provide a pressure relief function in case of a pressure surge in the discharge line.

Having thus described my invention with the detail and particularity required by the Patent Laws, what is desired and claimed to be protected by Letters Patent is set forth in the following claims.

I claim:

1. A wellpoint pumping system comprising a frame, a positive displacement rotary pump capable of pumping air, water or a mixture thereof mounted upon said frame, said pump having two rotors with intermeshing lobes mounted for counter rotation upon substantially horizontal and parallel shafts, said pump having an inlet port located blow said rotors opening downwardly and an outlet port located above said rotors opening upwardly, a motor for driving said rotors mounted upon said frame, means for coupling said motor to at least one of said rotor shafts to drive at least one of said rotor shafts, means forming a closed air-tight inlet reservoir in said frame below said pump, an outlet reservoir mounted on said frame at a level above said inlet reservoir, an exhaust conduit for said outlet reservoir, conduit means pendent from said pump inlet port extending into said inlet reservoir and terminating close to the bottom of said inlet reservoir, conduit means for placing said outlet port of said pump in communication with said outlet reservoir, water recirculation means for placing the lowermost portion of said outlet reservoir in communication with said air-tight inlet reservoir, and an adjustable recirculation control valve for controlling the rate of flow from the lowermost portion of said outlet reservoir to said inlet reservoir.

2. A wellpoint pumping system according to claim 1 including a check valve positioned in said exhaust conduit allowing flow only out from said outlet reservoir.

3. A wellpoint pumping system according to claim 1 wherein said inlet reservoir is divided to provide a suction box section in which a filter screen may be placed to remove solids from the intake fluid.

4. A wellpoint pumping system according to claim 1 wherein said frame defines multiple closed airtight compartments one of which is said inlet reservoir and the other of which is a fuel tank.

5. A wellpoint pumping system according to claim 1 wherein said pump rotor vanes are fabricated of a metal frame with an elastomer molded thereabout to define the shape of the vanes.

6. A wellpoint pumping system according to claim 5 wherein said rotor lobes have wear resistant, removable rotor shoes at each axial end and the pump has axial endwalls with adjustable wear plates enabling a close tolerance to be maintained between endwalls and rotor shoes.

7. A wellpoint pumping system according to claim 1 wherein a plurality of small holes are formed in said conduit means pendent from said pump inlet port allowing the pump to maintain a full level while pumping at steady state.

8. A wellpoint pumping system according to claim 1 wherein said recirculation control valve is a vacuum actuated valve responsive to the rate of flow of water to said pump.

9. A wellpoint pumping system according to claim 1 wherein said water recirculation means includes a depending conduit terminating in close proximity to the bottom of said inlet reservoir to continuously recirculate water between said outlet reservoir and said inlet reservoir and maintains a vacuum on said intake conduit, whereby the pumping system operates for extended periods of time with no inflow of water and/or air.

10. A wellpoint pumping system according to claim 1 including rotor shoes for said parallel shafts and seal means for said parallel shafts to prevent water leakage from said pump and air entry into said pump, said seal means consisting of a V ring seal and a high pressure lip seal mounted in a removable seal gland, the body of each seal gland partially sealing against a rotor shoe on its outside surface and partially sealing against a rotor shaft on its inside surface.

* * * * *

UNITED STATES PATENT AND TRADEMARK OFFICE

CERTIFICATE OF CORRECTION

PATENT NO. : 4,913,629

DATED : April 3, 1990

INVENTOR(S) : William C. Gilfillan

It is certified that error appears in the above-identified patent and that said Letters Patent is hereby corrected as shown below:

Column 1 Line 6 "we pumping" should read --wellpoint pumping--.

Column 3 Line 36 "IIA" should read --11A--.

Column 4 Line 24 "0.002" should read --.020--.

Column 4 Line 67 after "0.020" delete --±--.

Column 5 Line 21 "leakinq" should read --leaking--.

Claim 4 Line 19 Column 7 "airtight" should read --air-tight--.

Signed and Sealed this

Thirtieth Day of April, 1991

*Attest:*

HARRY F. MANBECK, JR.

*Attesting Officer*

*Commissioner of Patents and Trademarks*